US006793707B2

(12) United States Patent
Craig et al.

(10) Patent No.: US 6,793,707 B2
(45) Date of Patent: Sep. 21, 2004

(54) INOCULATION FILTER

(75) Inventors: Donald B. Craig, Fletcher, NC (US); Leonard S. Aubrey, Arden, NC (US); Thomas J. Margaria, Passy (FR)

(73) Assignees: Pechiney Electrometallurgie, Cedex (FR); Porvair PLC (GB)

( * ) Notice: Subject to any disclaimer, the term of this patent is extended or adjusted under 35 U.S.C. 154(b) by 0 days.

(21) Appl. No.: 10/043,644

(22) Filed: Jan. 10, 2002

(65) Prior Publication Data

US 2003/0126946 A1 Jul. 10, 2003

(51) Int. Cl.[7] ..... C21C 1/00; C22B 9/02

(52) U.S. Cl. ..... 75/305; 75/316; 75/407; 75/526; 420/29; 420/30; 420/31; 420/32; 420/33; 266/216

(58) Field of Search ..... 75/305, 316, 407, 75/526; 420/29–33; 266/216

(56) References Cited

U.S. PATENT DOCUMENTS

| | | | | |
|---|---|---|---|---|
| 3,137,570 A | | 6/1964 | Mickelson | 75/124 |
| 3,527,597 A | | 9/1970 | Dawson | 75/58 |
| 3,881,937 A | | 5/1975 | Teufel | 75/130 R |
| 3,961,663 A | | 6/1976 | Degois et al. | 164/58 |
| 4,054,275 A | * | 10/1977 | Cole et al. | 266/93 |
| 4,162,917 A | * | 7/1979 | McWhorter et al. | 420/21 |
| 4,568,388 A | | 2/1986 | Dremann et al. | 75/130 A |
| 4,666,516 A | | 5/1987 | Hornung et al. | 420/30 |
| 5,008,074 A | | 4/1991 | Naro et al. | 420/578 |
| 5,033,531 A | * | 7/1991 | Fisher et al. | 164/57.1 |
| 5,690,161 A | | 11/1997 | Daussan et al. | 164/358 |
| 6,102,983 A | | 8/2000 | Skaland et al. | 75/568 |
| 6,293,988 B1 | | 9/2001 | Naro | 75/305 |
| RE37,520 E | * | 1/2002 | Williamson | 148/321 |

FOREIGN PATENT DOCUMENTS

| | | |
|---|---|---|
| DE | 43 18 309 | 12/1994 |
| GB | 1433926 | 5/1976 |
| WO | 95/24508 | 9/1995 |

OTHER PUBLICATIONS

International Search Report, PCT/EP03/01210, published Oct. 9, 2003, Author: Mailliard.

"A New Approach to Ductile Iron Inoculation", American Foundry Society 2001, T. Skaland, pp. 77–88.

* cited by examiner

*Primary Examiner*—Melvyn Andrews
(74) *Attorney, Agent, or Firm*—Joseph T. Guy; Nexsen Pruet, LLC

(57) ABSTRACT

A method for inoculating molten iron. The method comprises passing the molten iron through a filter assembly at an approach velocity of about 1 to about 60 cm/sec. The filter assembly comprises a filter element and an inoculation pellet in contact with the filter element. The pellet has an inoculant dissolution rate of at least 1 mg/sec. to no more than 320 mg/sec. and comprises about 40–99.9%, by weight, carrier comprising ferrosilicon. The pellet further comprises about 0.1–60%, by weight, at least one inoculating agent selected from a group consisting of cerium, strontium, zirconium, calcium, manganese, barium, bismuth, magnesium, titanium and aluminum or from rare earths.

60 Claims, No Drawings

INOCULATION FILTER

TECHNICAL FIELD

The present invention is related to an improved method for inoculating cast iron late in the casting process and to an inoculant which affords more consistency in the inoculation of iron being cast. The inventive casting process, referred to as in the mold inoculation incorporates filtration and inoculation combining the advantages of both techniques for the manufacture of parts for which it is desired to obtain a structure free of iron carbides.

BACKGROUND

Cast iron is an extremely versatile engineered material comprising iron-carbon-silicon alloys that have been used in many commercial application manufacture of mechanical parts. The versatility of cast iron has led to the utilization of this material in many structural applications where the homogeneity and consistency of the iron will have a critical impact on the components performance. The casting of clean homogenous iron, specifically grey or ductile, is an essential step in the production of high quality engineered castings. Due to the importance of these cast items it is imperative that iron, specifically gray or ductile, be consistently cast with uniform morphology, with minimum included impurities and with properties that are reproducible.

Cast iron has an unusual metallurgical structure. Most metals form a single metallic crystalline structure during solidification. Cast iron, however, has a far more complex morphology during solidification. The crystalline phases that form during solidification of cast iron are dependent on the rate of solidification. Most engineered castings desire the formation of crystalline graphite within the iron matrix during solidification. If the cast iron solidifies too rapidly primary iron carbides can crystallize within the casting. Primary iron carbide is a hard brittle phase that makes the iron very difficult to machine and changes the physical and mechanical properties of the primary cast iron. Primary iron carbides are commonly referred to as "chill". Carbon contained as iron carbides is generally considered to be detrimental in most iron castings whereas carbon present as graphite improves the physical and mechanical properties of cast iron. Carbon can crystallize as either iron carbide or graphite during solidification. The formation of either phase is driven by the rate of solidification and the degree of nucleation contained within the liquid iron. The rate of solidification is constrained by the geometry of the casting, the rate of heat extraction of the mold material and the amount of superheat of the iron contained when the metal entered the mold. The degree of nucleation is constrained by the metallurgical history of the molten iron. Carbon present as graphite is an advantageous form and persuading carbon to crystallize as graphite is an ongoing goal of standard foundry operations. Graphite can be present in several morphological forms including spherical, as is the case with ductile iron, and flake-like, which is the case with gray iron.

Standard foundry metallurgical practice includes inoculation wherein the nucleation and growth of graphite is encouraged at the expense of iron carbide formation. Preferential nucleation greatly enhances the mechanical and physical properties of the finished casting. Inoculation is typically done by addition of an inoculating agent to either the pouring ladle, the metal stream or within the mold. The inoculating agent is typically added to the pouring ladle by pouring the granulated inoculating agent into the ladle when the ladle is filled with liquid iron, whereas the inoculant is added to the metal stream by injecting or spraying a finely divided powder of the inoculating agent in the molten metal stream as the molten metal enters the mold. It is typically desirable to add the inoculating agent to the molten metal as late as possible to minimize fading. Insufficient or improper inoculation is constantly at the forefront of losses due to poor quality in a foundry operation.

It may be preferred for the formed graphite to be spheroidal, if a spheroidal graphite cast iron called "SG" or "ductile" iron is required. Alternatively, a lamellar graphite cast iron is required for "LG" or "grey" iron. The essential prior condition to be met is to prevent the formation of primary iron carbide.

To this end the liquid cast iron is subject before casting to an inoculation treatment, which will, as it cools, favour the appearance of graphite rather than that of primary iron carbide.

The inoculation treatment is therefore very important. It is in fact well known that inoculation, whatever the inoculants used, has on the liquid cast iron an effectiveness which reduces with time and which, generally, has already reduced by 50% after a few minutes. To obtain maximum effectiveness, one skilled in the art generally practises progressive inoculation, applying to this end several additions of inoculants at different stages of the development of the cast iron. The final addition is made in the mold as the molds are fed or even in the feed conduits of the molds by placing in the path of the liquid cast iron inserts constituted by an inoculant material. These inserts are generally used associated with a filter; in this case they generally have a perfectly defined shape in order to be able to be fixed in the filter, most often in an adapted cavity. These inserts of defined shape are known as "pellets" or "slugs". We will denote by the name "filter inoculant package" the unit constituted by the pellet and the filter.

There are two types of pellets. "Molded" pellets are obtained by molding the molten inoculant. "Agglomerated" pellets are obtained from a pressed powder with generally very little binding agent, or even without binding agent.

Commercial inoculants create nucleation sites by seeding the liquid iron with highly reactive elements. The reactive elements combine with oxygen and sulfur dissolved within the liquid iron and the resultant reaction products precipitate out of solution to form nucleation sites for graphite during solidification. These nucleation products continue to grow within the melt until the metal has completely solidified. These particulates must be within a narrow size range in order to nucleate graphite crystal growth. Thus seeding the metal with the reactive elements as close to solidification as possible increases the probability that the precipitated particles remain within the narrow size window necessary for nucleation of graphite crystals. Formation of crystalline graphite is contrary to the kinetically favored products. The critical parameters which affect inoculation are not understood and are still the subject of academic debate. The ability of a skilled artisan to predict, and therefore improve, inoculation efficiency is very much desired in the art.

Pellet inoculation, wherein the molten metal is exposed to a pellet just prior to a filter, is known wherein a base material comprising minor amounts of calcium, aluminum, and rare earths are used. As the casting proceeds the inoculation efficiency changes with time due to the kinetics associated with dissolution of the inoculating agent from the pellet. Further complicating the problems of inoculation is the realization that various pour volumes and times are desired for manufacturing different parts with different sizes. If long pour times are utilized, the method of ladle inoculation is undesirable due to fading of the inoculant in the ladle. If short pour times are utilized, the time may by insufficient to allow for the onset of inoculation by pellet inoculation. The properties which allow for effective inoculation in the metal stream are not well understood and typically a suitable working range is developed by experimentation at great cost and loss of material.

The Daussan patent FR 2,692,654 describes a filter inoculant package wherein the pellet is obtained by agglomeration of powder at 0.5 to 2 mm preferentially. The efficiency of this filter inoculant package is quite limited.

The Foseco Patent EP 0 234 825 describes a filter inoculant package wherein the inoculant is presented in the form of a powdery non-agglomerated powder enclosed in a plastic pouch. This unit is more complex to manufacture and employs non-agglomerated powder whose wettability with respect to the liquid cast iron is not always well controlled.

Efforts to alleviate the problem of effective inoculation are presented in the art with limited success. DE Patent Publication DE 43 18 309 A1, for example, incorporates an inoculating pellet into a depression of a filter. The filter, in a honeycomb, comprises pores of 1 to 8 mm. The effectiveness of this type of filter inoculant package proves in use to be restricted by that of the pellet employed. This accomplishes the goal of inoculating late in the process but does not mitigate the primary issue associated with the process dependent inoculation efficiency described above. The pellet/filter combination has been found to be of limited value to foundries since it does not provide any benefit, other than localizing the pellet.

U.S. Pat. No. 6,293,988 provides an inoculating agent which comprises oxysulphides. The advantage provided is the elimination of ferrosilicon as a carrier medium. The oxysulphide inoculating agent dissolves slowly and the rate of inoculation, particularly early in the pour, may be inconsistent and unpredictable. A slowly dissolving pellet is subject to problems associated with inefficient inoculation early in the pour even though the problem of fade may be mitigated to some extent.

Inoculants utilizing ferrosilicon carriers are known to dissolve very rapidly and therefore there use for ladle inoculation is widely accepted. The rapid dissolution rate has caused ferrosilicon carrier based inoculants to be overlooked in the art due to the understanding that the rapid rate of dissolution would cause the pellet to be dissolved prior to the end of the pour and therefore the inoculant would not be effective throughout the entirity of the pour. The rapid dissolution rate has made the ferrosilicon based inoculant difficult to control.

Prior to the present invention, artisans have been restricted to the use of ferrosilicon based inoculants in the ladle, injecting a stream of inoculant into flowing metal and non-ferrosilicon based inoculants as a pellet. Furthermore, the artisan has had to choose between fade, with ladle inoculation, ineffective inoculation early in a pour with pellet inoculation or the mechanical complexities associated with injection inoculation.

There has been a long standing desire in the art for an inoculating agent, and method of use, which insures consistent and predictable inoculation regardless of the rate at which molten metal is poured. Prior to the present invention this desire has not been met.

SUMMARY

It is an object of the present invention to provide an inoculating pellet which consistently inoculates molten iron over a wide working range of pour times without fade or ineffective inoculation.

Another object of the invention is a filter inoculant package constituted by an agglomerated inoculant pellet and an associated filter, the respective characteristics of which have been adjusted to bring out a maximum synergy.

It is another object of the present invention to provide a system for inoculating molten iron which is easily controlled, does not limit the foundry operation and which can be utilized with virtually all existing foundry systems with minimal alteration of the physical structure and operational procedures.

It is another object of the present invention to provide an inoculation pellet which can be utilized to efficiently, and uniformly, inoculate molten iron over a wide range of approach velocities. This provides a particular advantage since the foundry can operate in a range which is dictated by manufacturing demands not limitations related to inoculation efficiency.

A particularly preferred embodiment is provided in a method for inoculating molten iron. The method comprises passing the molten iron through a filter assembly at an approach velocity of about 1 to about 60 cm/sec. The filter assembly comprises a filter element and an inoculation pellet in contact with the filter element. The pellet has an inoculant dissolution rate of at least 1 mg/sec. to no more than 320 mg/sec. and preferably comprises about 40–99.9%, by weight, carrier comprising ferrosilicon. The pellet further preferably comprises about 0.1–60%, by weight, at least one inoculating agent selected from rare earths or from a group consisting of cerium, strontium, zirconium, calcium, manganese, barium, bismuth, magnesium, titanium, aluminum, lanthanum and sulfur.

Another preferred embodiment is provided in an assembly comprising a filter and pellet for late inoculation of cast irons in their final filtration wherein said pellet is obtained by agglomeration of a powdered inoculant alloy and said filter is a refractory porous material, wherein said powdered inoculant of said pellet comprises a particle size distribution comprising 100%, by weight, less than 2 mm, 30–70%, by weight, between 50–250$\mu$, and less than 25%, by weight, below 50$\mu$ and said filter only allows particles below 10$\mu$ to pass there through.

Another preferred embodiment is provided in a filter assembly comprising a porous filter and an inoculant pellet. The inoculant pellet comprises a carrier and inoculating element. The carrier comprises at least 30%, by weight ferrosilicon. The inoculant comprises at least one inoculating agent selected from rare earths or from a group consisting of cerium, strontium, zirconium, calcium, manganese, barium, bismuth, magnesium, titanium, aluminum, lanthanum and sulfur.

Yet another preferred embodiment is provided in a method for inoculating molten iron. The method comprises passing the molten iron through a filter assembly at a rate of about 1–60 cm/sec. The filter assembly comprises a filter element and an inoculation pellet in contact with the filter element. The inoculant pellet comprises a binder and about 0.1–60%, by weight, inoculant. The inoculant comprises at least one inoculating agent selected from rare earths or from a group consisting of cerium, strontium, zirconium, calcium, manganese, barium, bismuth, aluminum, lanthanum and sulfur. The pellet has an inoculant dissolution rate of at least about 1 mg/sec. to no more than about 320 mg/sec.

Yet another preferred embodiment is provided in a process for molding iron comprising the steps of a) melting iron to form molten iron;

b) transporting the molten iron to a filter assembly wherein the filter assembly comprises a filter element and an inoculation pellet in contact with the filter element and wherein the inoculant pellet comprises a carrier and about 0.1–60%, by weight, active inoculant comprising at least one inoculating agent selected from the rare earths or from a group consisting of cerium, strontium, zirconium, calcium, manganese, barium, bismuth, magnesium, titanium, aluminum, lanthanum and sulfur and wherein the pellet has an inoculant dissolution rate of at least about 1 mg/sec. to no more than about 320 mg/sec;

c) passing the molten iron through the filter assembly at a rate of about 1 to about 60 cm/sec., measured at 30.25 $cm^2$ cross section, to form inoculated filtered iron; transporting the inoculated filtered iron to a mold forming a molten shape; and d) cooling the molten shape to form the molded iron.

Yet another preferred embodiment is provided in a pellet for inoculating iron in a mold. The pellet comprises about 40–99.9%, by weight, carrier and about 0.1–60%, by weight, inoculant. The carrier comprises at least about 30%, by weight, ferrosilicon. The inoculant comprises at least one inoculating agent selected from the rare earths or from a group consisting of cerium, strontium, zirconium, calcium, manganese, barium, bismuth, magnesium, titanium, aluminum, lanthanum and sulfur. The pellet has an inoculant dissolution rate of at least about 2 to about 250 mg/sec. measured at 15 cm/sec approach velocity with a 30.25 $cm^2$ iron flow.

DETAILED DESCRIPTION

The present invention relates to an inoculation pellet, system and method for use which greatly increases the consistency with which molten metal, particularly iron, can be inoculated. The art of inoculation with a pellet has previously met with limited success. Non-ferrosilicon based pellets, such as those described in U.S. Pat. No. 6,293,988 dissolve slowly and the resulting cast iron still comprises chill consistent with inappropriate inoculation. The art has been lacking in a teaching which provides a ferrosilicon based inoculant pellet which can be utilized over a broad range of flow rates, or approach velocities, with adequate inoculation and minimal fading. Through diligent research such teaching is provided herein.

One skilled in the art who practices inoculation at the different stages of the development of the cast iron uses products which are all the finer the later the inoculant is added in the process. The logic is that upstream the products have all the time necessary to dissolve and that when they reach the inlet of the molds they have only a few seconds left before solidification.

Granulated 2 to 10 mm particles are currently used in pre-inoculation, 0.2 to 2 mm granulated particles are used during ladle treatment, and 0.2 to 0.7 mm granulated particles are used for stream inoculation when casting. The applicant has in fact noted an unexpected phenomenon in the testing shop. For a same dosing of inoculant, the number of graphite nuclei generated in the liquid cast iron increases with the number of inoculant particles added to the inoculant mass unit. Therefore, if two ladles of cast iron are treated in identical conditions with a same inoculant in two different particle size distributions, the cast iron treated with the finest product will contain more graphite nuclei that that treated with the coarser product. These nuclei will also be smaller in size.

The same phenomenon has been observed during an in the mold treatment with agglomerated pellets. The cast iron treated with a pellet obtained from a finer powder will contain more graphite nuclei than that treated with a pellet obtained from a coarser powder. These nuclei will also be smaller in size.

To obtain pellets in this way which have maximum effectiveness in terms of inoculation, the applicant has been led to prepare powders at 0 to 2 mm having a particular internal particle size distribution defined in the following way: passing to 2 mm: 100%; passing between 50$\mu$ and 250$\mu$: 30 to 70%, more preferably 40 to 60%; fraction below 50$\mu$: less than 25%, more preferably less than 20%.

A powder of this type agglomerates easily which makes it possible to operate with lower proportions of binding agent. Thus, with sodium silicate which is a well known binding agent, doses of 0.3 $cm^3$ for 100 g of powder to 3 $cm^3$ for 100 g of powder are sufficient according to the pressures employed which may vary from 50 to 500 MPa since the mechanical performance of the pellets is easily acquired. The pressure and binding agent percentage parameters may be used to control the dissolution speed of the pellet and not its mechanical performance.

Experience shows that the particle size distribution defined above cannot be obtained by natural crushing. The preparation of powder of this particle size distribution requires a dosing of size fractions prepared in isolation.

The filter associated with the pellet is a ceramic filter comprising continuous or semi-continuous voids or passageways which the metal passes an in which any included particles larger than 10$\mu$ and preferably 3$\mu$ become lodged.

Controlling the dissolution rate to allow for a wide range of flow rates, or approach velocities, now allows for predictable inoculation without regard for approach velocities within a working range of 1–60 cm/sec measured at 30.25 $cm^2$ flow cross-section.

The effective component of the present invention comprises a ferrosilicon carrier and at least one active element. The ferrosilicon carrier is a low-active element which dissolves in molten iron without significantly forming seed nuclei. The active element is an element, or combination of elements, which dissolve in molten iron and react with elements in the molten iron to form seed nuclei upon which graphite preferentially crystallizes.

The effective component of the inoculant pellet preferably comprises 40–99.9%, by weight, carrier and 0.1–60%, by weight active element. Particularly preferred carriers are prepared from ferrosilicon comprising non-reactive impurities. Ferrosilicon is available commercially from a variety of sources. Ferrosilicon is typically provided as 75% ferrosilicon which indicates, by nomenclature in the art, that the material comprises approximately 75%, by weight, silicon and 25%, by weight, iron. Ferrosilicon is as widely available as 50% ferrosilicon which indicates that the material comprises approximately 50%, by weight, silicon and 50%, by weight, iron. For the purposes of the present invention the binder includes all non-inoculating elements. It is most preferred that the carrier comprise at least about 30%, by weight ferrosilicon. It is preferable to add a binder to the effective components prior to forming a pellet. The binder, such as sodium silicate, is well known in the art to assist in pellitization of a powder.

The active elements of the present invention include at least one rare earth or at least one inoculating agent chosen from the group consisting of cerium, strontium, zirconium, calcium, manganese, barium, bismuth, magnesium, titanium, aluminum, lanthanum and sulfur. Particularly preferred inoculating agents include at least one element chosen from the group consisting of strontium, aluminum, lathanum, zirconium, calcium and manganese. The inoculant preferably comprises about 0.1–60%, by weight inoculating agent. More preferably, the inoculant comprises about 0.1–40%, by weight, active inoculating agent. Most preferably, the inoculant comprises about 0.1–20%, by weight, active inoculating agent.

Approach velocity is a practical measure, well known in the industry, to indicate the volume of metal flowing to, and through, a filter. As would be apparent to one of ordinary skill in the art the approach velocity is determined at a fixed cross-sectional flow area. For the purposes of the present invention all approach velocities are calculated at a cross-sectional area of 30.25 $cm^2$ unless otherwise stated. It would be readily apparent to one of ordinary skill in the art that different cross-sectional areas would generate different approach velocities, however, the approach velocity could be easily compared to those cited herein by simple conversion as known in the art.

The dissolution rate of the inoculant is defined as the amount of inoculating agent consumed as a function of time. The analysis of certain inoculants is difficult therefore the dissolution rate is based on the analysis of a determinant element, either an inoculant or marker. The weight ratio of the determinant element to other inoculating agents is assumed to be the same in the cast iron as the weight ratio in the original pellet. For the purposes of the present invention zirconium is used as an inoculating determinate element. Therefore, the total inoculant in the cast iron is determined as the amount of zirconium plus other inoculants in the iron. For example, if an inoculant has 1 part zirconium, by weight, to 1 part manganese, by weight, and the amount of zirconium in the iron is 20 ppm then the amount of manganese will also be 20 ppm for a total inoculant of 40 ppm. The grams of zirconium plus manganese, which is present in an amount of 40 ppm, divided by the pour time is the inoculant dissolution rate.

An inoculant dissolution rate of at least approximately 1 mg/sec. is necessary to have sufficient inoculation for approach velocities of 1–60 cm/sec. Below 1 mg/sec. an insufficient inoculation rate is observed, particularly early in the pour, to insure minimum or no chill and to substantially eliminate the formation of iron carbide. Alternatively, the approach velocity must be lowered to a level which is impractical with an inoculant dissolution rate below approximately 1 mg/sec. More preferably, the inoculant dissolution rate is no less than 10 mg/sec. More preferably, the inoculant dissolution rate is no less than 20 mg/sec. An inoculant dissolution rate of no more than approximately 320 mg/sec. is required to insure that the rate of dissolution is sufficiently slow to insure that pellet remains throughout the entire pour at approach velocities of 1–60 cm/sec. Above approximately 320 mg/sec. the pellet may dissolve prematurely thereby failing to inoculate the late portions of the pour. Alternatively, the approach velocity must be increased to a level which is impractical. More preferably, the inoculant dissolution rate is no more than approximately 250 mg/sec. Most preferably, the inoculant dissolution rate is no more than approximately 200 mg/sec.

Commercially available ferrosilicon based inoculants dissolve at a rate which exceeds 320 mg/sec. While imminently suitable for use in ladle inoculation these have been found to be unsuitable for use in a pellet at the point of filtration. Prior to the present invention the rate of dissolution for ferrosilicon based inoculants has not been explored due to the understanding in the art that the rate was to fast to be applied in this manner. The present invention illustrates that a ferrosilicon based inoculant can be prepared which, when prepared to a narrow range of dissolution rate, can be utilized as an inoculant pellet and the resulting cast iron has a low level of chill. Furthermore, the proper dissolution rate, which was previously not realized in the art, allows for superior inoculation with minimal inoculating agent. This substantially decreases the cost of inoculation and increases the predictability. Yet another advantage offered by the teachings herein is the ability to determine the proper amount of inoculant pellet to achieve a proper level of inoculation.

A dissolution rate of approximately 1 to approximately 320 mg/sec. allows for an inventive pellet to by used at approach velocities of 1–60 cm/sec. without fade or under inoculation in any portion of the pour. This is currently not available in the art without utilizing very large pellets which are only partially used or approach velocities which are undesirable. More preferably, the dissolution rate is approximately 1 to approximately 320 mg/sec. at approach velocities of approximately 1 to approximately 40 cm/sec. Even more preferably, approach velocities of 10 to 30 cm/sec. can be utilized and most preferably an approach velocity of 15–25 cm/sec. can be utilized with the preferred pellet dissolution rate of 2 to 250 mg/sec. A particularly preferred pellet dissolution rate is 2 to 150 mg/sec.

In a particularly preferred embodiment the dissolution rate of the pellet is determined at an approach velocity of 15 cm/sec. measured at a cross-sectional area of 30.25 $cm^2$. At an approach velocity of 15 cm/sec. the pellet preferably has a dissolution rate of at least approximately 2 mg/sec. to no more than approximately 300 mg/sec. More preferably, measured at an approach velocity of 15 cm/sec. the pellet has a preferred dissolution rate of at least approximately 2 mg/sec. to no more than approximately 200 mg/sec.

The filtration rate of the filter can be adjusted between 0.01 $kg/(s \cdot cm^2)$ and 0.5 $kg/(s \cdot cm^2)$. More preferably between 0.04 $kg/(s \cdot cm^2)$ and 0.24 $kg/(s \cdot cm^2)$ according to the application.

Due to the inoculation rate generally required which is between 0.05% and 0.15% and due to the filtration capacity of the filter of the invention, which is between 1 and 1.5 kg of liquid iron per $cm^2$, the filter inoculant package is sized with a ratio (pellet mass in g/filter surface in $cm^2$) between 0.75 and 1.5. For instance, a filter inoculant package made of a 25 g pellet and a 30 $cm^2$ filter would be a convenient sizing.

The dissolution rate of the pellet is controlled by composition and packing density. As the packing density increases the dissolution rate decreases. For the purposes of the present invention a ferrosilicon binder compressed to achieve a density of approximately 2.3 g/cc to approximately 2.6 g/cc is suitable to obtain the dissolution range required for the invention. Such a result can be obtained in adjusting the density of a pellet which can be obtained between 60% and 80% of the true density of the inoculant alloy the pellet is made of, depending on the pressure used for agglomerating which can vary from 50 to 500 MPa. Filter inoculant packages according to the invention, may be sized for the treatment of molten iron flow rates between 1 and 25 kg/s.

Ceramic filter elements are porous members comprising continuous or semi-continuous voids or passageways through which the metal passes and in which any included particles become lodged. The porous ceramic filter elements are preferably prepared by the manner described in U.S. Pat. No. 4,056,586, which is incorporated herein by reference. Further elaboration on methods for manufacturing ceramic filter elements is provided in U.S. Pat. Nos. 5,673,902 and 5,456,833, both of which are included herein by reference.

EXPERIMENTAL

Examples 1 to 5 are related to ductile cast irons. Example 6 is related to grey cast iron

EXAMPLE 1

A batch "A" of commercially available agglomerated inoculant pellets of the prior art was acquired and analysed. The analysis gave: Si=72.1%, Al=2.57% and Ca=0.52%. A batch of molten inoculant of analysis as close as possible to that of the previous batch was synthesized in the induction furnace from FeSi 75, the strength of which was corrected by adding calcium silicide, aluminum then iron. This batch of inoculant was then cast in 25 g molded pellets. Sampling and analysis of this batch of pellets designated "B" gave: Si=72.4%, Al=2.83% and Ca=0.42%. A series of 30.25 $cm^2$ square silicon carbide ceramic filters were prepared using standard techniques. An organic foam was coated with a ceramic slurry such that all voids were filled. The organic foam was then compressed to expel excess slurry. The coated organic foam slurry was then dried and fired. A circular void, 24 mm in diameter, was cut partially into a surface of the filter for fitting of the pellet.

EXAMPLE 2

A charge of cast iron was melted in the induction furnace and treated by the Tundish Cover process by means of an alloy of the FeSiMg type with 5% Mg, 2% Ca, and 2% total rare earths (TRE) at the dose of 20 kg for 1600 kg of cast iron. The analysis of this liquid cast iron gave: C=3.7%; Si=2.5%, Mn=0.09%, P=0.03%, S=0.003%, Mg=0.042%. Its eutectic temperature was 1141° C. This cast iron was used to cast parts with a unit mass of about 1 kg, placed in clusters in a 20 part mold fed by an inflow conduit in which was placed a molded pellet of batch "B". The number of graphite nodules observed by metallography on the cross-section of the parts was 184/ $mm^2$.

EXAMPLE 3

Example No. 2 was reproduced in an identical way with the sole difference that the molded slug coming from batch "B" was replaced with an agglomerated pellet according to the prior art obtained by pressing a powder 0 to 2 mm obtained by natural crushing of molded pellets taken from the same batch "B" as the pellet used in the previous example. The particle size distribution of this powder was: passing to 2 mm: 100%; passing to 0.4 mm: 42%; passing to 0.2 mm: 20%; passing to 50$\mu$: 10%, i.e. a particle size distribution quite close to that recommended in EP 0 234 825. The number of graphite nodules observed by metallography on the cross-section of the parts was 168/$mm^2$.

EXAMPLE 4

Example No. 3 was reproduced in an identical way with the sole difference that the molded slug came from batch "A". The number of graphite nodules observed by metallography on the cross-section of the pellets was 170/$mm^2$.

EXAMPLE 5

Example No. 3 was repeated with the following conditions. A 25 kg batch of molded slugs from batch "B" was crushed to 0 to 1 mm. The fractions 0.63 to 1 mm; 0.40 to 0.63 mm; 0.25 to 0.40 mm; 0.050 to 0.25 mm and 0 to 0.050 mm were separated by screening. Obtained was 3.5 kg of 0.63 to 1 mm; 3.9 kg of 0.40 to 0.63 mm; 4.2 kg of 0.25 to 0.40 mm kg of 0.050 to 0.25 mm and 6.1 kg of 0 to 0.050 mm. A powder was prepared by blending: 2 kg of 0.63 to 1 mm; 2 kg of 0.40 to 0.63 mm; 2 kg of 0.25 to 0.40 mm; 7 kg of 0.050 to and 2 kg of 0 to 0.050 mm. To this 15 kg powder blend was added: 150 $cm^3$ of sodium silicate and 150 $cm^3$ of 10 normal sodium hydroxide. The blend obtained was used to manufacture cylindrically shaped agglomerated pellets 24 mm in diameter, 22 mm thick. The pressure exerted on the pellet to shape it was 285 MPa for 1 second. The shaped pellets were stored at 25° C. for 8 hours in a carefully ventilated location and were then oven dried at 110° C. for 4 hours. The pellets obtained, of 25 g unit mass, constituted a batch denoted batch "C". Example No. 3 was then repeated with pellets coming from batch "C" assembled with a ceramic foam filter identical to that used in example No. 2. The number of graphite nodules observed by metallography on the cross-section of the parts was 234/mm.

EXAMPLE 6

Example No. 5 was repeated with the following conditions. A charge of 1600 kg of cast iron was melted in an induction furnace. A sample was taken of the liquid metal and analyzed. The analysis gave: C=3.15%, Si=1.82%, Mn=0.71%, P=0.15%, S=0.08%. The eutectic temperature was 1136° C. The cast iron was used to cast parts with a unit mass of about 1 kg, placed in clusters in a 20 part mold fed by an inflow conduit in which was placed a molded pellet supported by a 30.25 $cm^2$ filter constituted by a refractory foam identical to the ones used in the other examples. The molded slug was from batch "C". The number of eutectic cells observed by metallography on the cross section of the part was 310/$mm^2$.

Inventive Example 7

A series of 30.25 cm square silicon carbide ceramic filters were prepared using standard techniques. An organic foam was coated with a ceramic slurry such that all voids were filled. The organic foam was then compressed to expel excess slurry there from while leaving the organic foam coated with slurry. The coated organic foam slurry was then dried and fired. A circular void, approximately 25.4 mm in diameter, was cut partially into a surface of the filter for fitting of the pellet.

A series of cylindrical pellets, approximately 20.5 mm in thickness and approximately 25.4 mm in diameter were prepared creating an alloy of active ingredients with silicon and iron. The alloy was melted, crushed, pulverized, sized and mixed with sodium silicate to form a pellet. The powder was placed in a mold and compressed to a level sufficient to obtain the density required of approximately 2.3 to 2.6 g/cc. The pellet was then inserted into the circular void of the ceramic filter.

A test mold comprising 5 chambers of equal size wherein each chamber is filled sequentially in a single pour was used to determine the dissolution rate of the pellet/filter combination throughout the pour. The pellet/filter combination was inserted into the test mold prior to the chambers and 29.51 Kg of molten iron was poured into the mold over different periods of time. Temperatures during the pour were determined to range from 1335–1470° C. with no significant difference noted within this range of temperature.

Multiple core samples were taken from plates cast in the first, third and fifth chambers of the test mold and the core samples were dissolved and analyzed for zirconium by inductively coupled plasma spectrometry. The average zirconium level was defined as the Average Inoculation (AI). The Approach Velocity (AV), which is the velocity of metal at the leading edge of the filter was calculated from the following equation:

$$AV=PW/(D*EFA*t)$$

where PW is the pour weight in grams; D is metal density in grams per cubic centimeter, EFA is effective filter area in $cm^2$, or the surface area of the filter which is not covered by pellet and t is time in seconds. The average dissolution rate (ADR) was determined as the total grams of inoculating agent consumed by the metal, based on the analysis of zirconium, over the total pour time. The results are provided in Table 1.

After the pour was complete the pellet was no longer visible on the filter. The presence of adequate inoculation in the first and last plates indicated that the dissolution rate was sufficient to effectively inoculate the entire pour without chill due to poor inoculation in any sample.

Analysis of the cast iron indicated that all of the inventive samples had adequate inoculation as indicated in the average inoculation (AI) which is based on the level of zirconium in the cast iron.

TABLE 1

| Sample | AV (cm/sec.) | AI (ppm Zr) | ADR (g/sec.) | Pour Time (sec.) |
|---|---|---|---|---|
| 1 | 27.45 | 27 | 0.3104 | 7 |
| 2 | 21.35 | 17 | 0.149 | 9 |
| 3 | 19.21 | 15 | 0.1234 | 10 |
| 4 | 17.47 | 25 | 0.1854 | 11 |
| 5 | 17.47 | 17 | 0.1244 | 11 |
| 6 | 16.01 | 14 | 0.0939 | 12 |
| 7 | 14.78 | 14 | 0.0867 | 13 |
| 8 | 13.72 | 15 | 0.0862 | 14 |
| 9 | 13.72 | 20 | 0.1169 | 14 |
| 10 | 12.81 | 20 | 0.1091 | 15 |
| 11 | 12.81 | 12 | 0.0644 | 15 |
| 12 | 12.81 | 19 | 0.1022 | 15 |
| 13 | 12.81 | 15 | 0.0823 | 15 |
| 14 | 12.81 | 16 | 0.0876 | 15 |
| 15 | 12.01 | 26 | 0.1325 | 16 |
| 16 | 12.01 | 15 | 0.0771 | 16 |
| 17 | 12.01 | 14 | 0.0687 | 16 |
| 18 | 11.3 | 19 | 0.09 | 17 |
| 19 | 11.3 | 20 | 0.0963 | 17 |
| 20 | 10.67 | 15 | 0.0686 | 18 |
| 21 | 10.67 | 19 | 0.0864 | 18 |
| 22 | 9.61 | 16 | 0.0657 | 20 |
| 23 | 7.68 | 24 | 0.0762 | 25 |
| 24 | 7.68 | 23 | 0.074 | 25 |
| 25 | 7.39 | 19 | 0.0588 | 26 |
| 26 | 7.12 | 18 | 0.0537 | 27 |
| 27 | 7.12 | 18 | 0.0527 | 27 |
| 28 | 6.4 | 17 | 0.0447 | 30 |
| 29 | 4.8 | 21 | 0.0416 | 40 |
| 30 | 4.09 | 14 | 0.0234 | 47 |

Comparative Example

A ferrosilicon pellet was prepared as in the inventive example except the particle size and packing as commonly employed in ferrosilicon based inoculants. The dissolution rate was estimated by pellet loss analysis and inoculant element percentage. The results are provided in Table 2.

TABLE 2

| Sample | AV(cm/sec) | ADR(g/sec.) | Pour Time(sec.) |
|---|---|---|---|
| C1 | 14 | 0.349 | 6 |
| C2 | 17 | 0.42 | 5 |
| C3 | 16 | 0.42 | 5 |
| C4 | 13 | 0.349 | 6 |

The dissolution rate was too high to be an effective inoculant.

Comparative Example 2

A round inoculation disk with a diameter of 26.4 mm and a thickness of approximately 17 mm was inserted into a SELEE® silicon carbide filter. The inoculation disk comprised 15–49%, by weight, silicon; 7–22%, by weight, calcium; 2.5–10%, by weight, sulfur; 2.5–7.5%, by weight, magnesium and 0.5–5%, by weight, aluminum. Samples of 20 kg–29 kg Gray iron were poured through the filter at an approach velocity of approximately 12–18 cm/sec. After the pour was complete the remaining pellet was analyzed by SEM/EDS. A similar analysis was not possible with the inventive examples since the pellet was no longer distinguishable. The analysis suggested the formation of complex dross formations including silicates and sulfides of calcium magnesium aluminum compounds.

An independent analysis of cast iron utilizing the comparative pellet indicated formation of iron carbide with minimal formation of flake graphite thereby indicating ineffective inoculation.

It is apparent from the description and examples herein that effective inoculation can be accomplished utilizing ferrosilicon based pellets in contact with a filter element. It is unexpected that this combination would be suitable based on the knowledge in the art. Of further surprise is the observation that superior inoculation can be obtained wherein formation of carbides is substantially eliminated and chill control is excellent throughout the duration of a pour. This is an advance in the art which is contrary to the expectations of skilled artisans and based on manipulation of properties of ferrosilicon based inoculants which were previously not exploited based on the previously held belief in the art that pellet inoculation with ferrosilicon based pellets would expected to be undesirable.

The invention has been described with particular emphasis on the preferred embodiments. It would be apparent to one of ordinary skill in the art that alternate embodiments could be realized without departing from the scope of the invention which is set forth in the appended claims.

What is claimed is:

1. An assembly comprising a filter and pellet for late inoculation of cast irons in their final filtration wherein said pellet is obtained by agglomeration of a powdered inoculant alloy and said filter is a refractory porous material, wherein said powdered inoculant of said pellet comprises a particle size distribution comprising 100%, by weight, less than 2 mm; 30–70%, by weight, between 50–250$\mu$, and less than 25%, by weight, below 50 $\mu$ and said filter only allows particles below 10$\mu$ to pass there through.

2. The assembly of claim 1 wherein said filter only allows particles below 3$\mu$ to pass there through.

3. The assembly of claim 1 wherein said pellet has a mass, measured in grams, and said filter has a surface area, measured in $cm^2$, and a ratio of said grams to said surface area is at least 0.75 to no more than 1.5.

4. An assembly comprising a filter and pellet for late inoculation of cast irons in their final filtration wherein said pellet is obtained by agglomeration of a powdered inoculant alloy and said filter is a refractory porous material, wherein said powdered inoculant of said pellet comprises a particle size distribution comprising 100%, by weight, less than 2 mm; 30–70%, by weight, between 50–250$\mu$, and less than 25%, by weight, below 50$\mu$ and said filter only allows particles below 10$\mu$ to pass there through at a molten cast iron flow rate of at least 1 kg/s to no more than 25 kg/s.

5. The assembly of claim 1 wherein said pellet has an inoculant alloy powder comprising between 40% and 60%, by weight, said between 50–250$\mu$ and less than 20%, by weight, below said fraction below 50$\mu$.

6. The assembly of claim 1 wherein said powdered inoculant comprises a blend of two or more inoculant powder alloys.

7. The assembly of claim 1 wherein said powdered inoculant is a blend of two or more products constituting a heterogenous inoculant.

8. The assembly of claim 1 wherein said pellet comprises an active component comprising about 40–99.9%, by weight carrier comprising ferrosilicon and about 0.1–60%, by weight, and at least one inoculating agent selected from rare earths.

9. The assembly of claim 1 wherein said pellet comprises an active component comprising about 40–99.9%, by weight carrier comprising ferrosilicon and about 0.1–60%, by weight, and at least one inoculating agent selected from a group consisting of cerium, strontium, zirconium, calcium, manganese, barium, bismuth, magnesium, titanium, aluminum, lanthanum and sulfur.

10. The assembly of claim 9 wherein said pellet comprises at least one inoculating element selected from a group consisting of strontium, zirconium, calcium, lanthanum, manganese and aluminum.

11. The assembly of claim 9 wherein said pellet comprises about 0.1–40%, by weight, inoculating element.

12. The method for inoculating molten iron of claim 11 wherein said pellet comprises about 0.1–20%, by weight, inoculating element.

13. The assembly of claim 1 wherein said pellet has an inoculant dissolution rate of at least 1 mg/sec. to no more than 320 mg/sec.

14. The assembly of claim 13 wherein said pellet has an inoculant dissolution rate of at least 10 mg/sec.

15. The assembly of claim 14 wherein said pellet has an inoculant dissolution rate of at least 20 mg/sec.

16. The assembly of claim 13 wherein said pellet has an inoculant dissolution rate of no more than 250 mg/sec.

17. The assembly of claim 16 wherein said pellet has an inoculant dissolution rate of no more than 200 mg/sec.

18. A method for inoculating molten iron comprising passing said molten iron through a filter assembly at an approach velocity of about 1 to about 60 cm/sec. wherein said filter assembly comprises a filter element and an inoculation pellet in contact with said filter element wherein said pellet has an inoculant dissolution rate of at least 1 mg/sec. to no more than 320 mg/sec.

19. The method for inoculating molten iron of claim 18 wherein said inoculant dissolution rate is at least 10 mg/sec.

20. The method for inoculating molten iron of claim 19 wherein said inoculant dissolution rate is at least 20 mg/sec.

21. The method for inoculating molten iron of claim 18 wherein said inoculation pellet comprises an active component comprising about 40–99.9%, by weight carrier comprising ferrosilicon and about 0.1–60%, by weight, at least one inoculating agent selected from rare earths.

22. The method for inoculating molten iron of claim 18 wherein said inoculation pellet comprises an active component comprising about 40–99.9%, by weight carrier comprising ferrosilicon and about 0.1–60%, by weight, at least one inoculating agent selected from a group consisting of cerium, strontium, zirconium, calcium, manganese, barium, bismuth, magnesium, titanium, aluminum, lanthanum and sulfur.

23. The method for inoculating molten iron of claim 22 wherein said pellet comprises at least one inoculating element selected from a group consisting of strontium, zirconium calcium, aluminum, lanthanum and manganese.

24. The method for inoculating molten iron of claim 18 wherein said pellet has an inoculant dissolution rate of at least 2 mg/sec.

25. The method for inoculating molten iron of claim 21 wherein said pellet has an inoculant dissolution rate of at least 2 mg/sec.

26. The method for inoculating molten iron of claim 18 wherein said pellet has an inoculant dissolution rate of no more than 250 mg/sec.

27. The method for inoculating molten iron of claim 26 wherein said pellet has an inoculant dissolution rate of no more than 200 mg/sec.

28. The method for inoculating molten iron of claim 18 wherein said approach velocity is about 1 to about 40 cm/sec.

29. The method for inoculating molten iron of claim 28 wherein said approach velocity is about 10 to about 30 cm/sec.

30. The method for inoculating molten iron of claim 18 wherein said approach velocity is about 15 to about 25 cm/sec. and said inoculant dissolution rate is at least about 2 to no more than about 250 mg/sec.

31. The method for inoculating molten iron of claim 18 wherein said pellet comprises about 0.1–40%, by weight, inoculating element.

32. The method for inoculating molten iron of claim 31 wherein said pellet comprises about 0.1–20%, by weight, inoculating element.

33. The method for inoculating iron of claim 18 wherein said pellet comprises an agglomerated powder inoculant pellet comprising a particle size distribution comprising 100%, by weight, less than 2 mm; 30–70%, by weight, between 50-250$\mu$, and less than 25%, by weight, below 50$\mu$ and said filter only allows particles below 10 $\mu$ to pass there through.

34. The method for inoculating iron of claim 33 wherein said pellet has an agglomerated powder inoculating pellet comprising between 40% and 60%, by weight, particles between 50–250$\mu$, and less than 20% by weight below 50$\mu$.

35. The method for inoculating iron of claim 33 wherein said filter only allows particles below 3$\mu$ to pass there through.

36. The method for inoculating iron of claim 18 wherein said pellet has a mass, measured in grams, and said filter has a surface area, measured in $cm^2$, and a ratio of said mass to said surface area is at least 0.75 to no more than 1.5.

37. The method for inoculating iron of claim 18 wherein said filter assembly treats a molten cast iron flow rate of at least 1 kg/s to no more than 25 kg/s.

38. A filter assembly comprising a porous filter and an inoculant pellet wherein said inoculant pellet comprises a carrier and inoculant wherein:

said carrier comprises at least 30%, by weight ferrosilicon; and said inoculant comprises at least one inoculating agent selected from a group consisting of cerium, strontium, zirconium, calcium, manganese, barium, bismuth, magnesium, titanium, aluminum, lanthanum and sulfur wherein said filter only passes particles below 10$\mu$ in size.

39. A filter assembly comprising a porous filter and an inoculant pellet wherein said inoculant pellet comprises a carrier and inoculant wherein:

said carrier comprises at least 30%, by weight ferrosilicon; and said inoculant comprises at least one inoculating agent selected from a group consisting of cerium, strontium, zirconium, calcium, manganese, barium, bismuth, magnesium, titanium, aluminum, lanthanum and sulfur wherein said pellet has a mass, measured in grams, and said filter has a surface area, measured in $cm^2$, and a ratio of said mass to said surface area is at least 0.75 to no more than 1.5.

40. The filter assembly of claim 38 wherein said pellet comprises about 40–99.9%, by weight, said carrier and about 0.1–60%, by weight said inoculant.

41. The filter assembly of claim 40 wherein said pellet comprises about 0.1–20%, by weight said inoculant.

42. A method for inoculating molten iron comprising the steps of:

passing said molten iron through a filter assembly at a rate of about 1–60 cm/sec. wherein said filter assembly comprises a filter element and an inoculation pellet in contact with said filter element wherein said inoculant pellet comprises a carrier and about 0.1–60%, by weight, inoculant comprising at least one inoculating agent selected from a group consisting of cerium, strontium, zirconium, calcium, manganese, barium, bismuth, magnesium, titanium, aluminum, lanthanum and sulfur wherein said pellet has an inoculant dissolution rate of at least about 1 mg/sec. to no more than about 320 mg/sec. thereby forming inoculated molten iron; and collecting said inoculating molten iron.

43. The method for inoculating molten iron of claim 42 wherein said inoculating agent is selected from a group consisting of strontium, calcium, aluminum, zirconium, lanthanum and manganese.

44. The method for inoculating molten iron of claim 42 wherein said pellet has an inoculant dissolution rate of at least about 2 to about 250 mg/sec.

45. The method for inoculating molten iron of claim 42 wherein said pellet has an inoculant dissolution rate of at least about 2 to about 250 mg/sec. measured with a 30.25 $cm^2$ cross-sectional flow.

46. The method for inoculating molten iron of claim 42 wherein said filter element comprises a central partial bore and said pellet is received in said central partial bore.

47. The method for inoculating molten iron of claim 42 wherein said carrier comprises at least 30%, by weight, ferrosilicon.

48. The method for inoculating molten iron of claim 42 wherein said pellet comprises about 0.1–20%, by weight, inoculant.

49. The method for inoculating iron of claim 42 wherein said pellet comprises agglomerated powder inoculant comprising a particle size distribution comprising 100%, by weight, less than 2 mm; 30–70%, by weight, between 50–250$\mu$, and less than 25%, by weight, below 50$\mu$ and said filter only allows particles below 10 $\mu$ to pass there through.

50. The method for inoculating iron of claim 49 wherein said pellet has an inoculant alloy powder comprising between 40% and 60%, by weight, between 50–250 $\mu$, and less than 20% by weight below 50$\mu$.

51. The method for inoculating iron of claim 49 wherein said filter only allows particles below 3$\mu$ to pass there through.

52. The method for inoculating iron of claim 42 wherein said pellet has a mass, measured in grams, and said filter has a surface area, measured in $cm^2$, and a ratio of said mass to said surface area is at least 0.75 to no more than 1.5.

53. The method for inoculating iron of claim 42 wherein said filter assembly treats a molten cast iron flow rate of at least 1 kg/s to no more than 25 kg/s.

54. A process for molding iron comprising the steps of:

melting iron to form molten iron;

transporting said molten iron to a filter assembly wherein said filter assembly comprises a filter element and an inoculation pellet in contact with said filter element wherein said inoculant pellet comprises a carrier and about 0.1–60%, by weight, inoculant comprising at least one inoculating agent selected from a group consisting of cerium, strontium, zirconium, calcium, manganese, barium, bismuth, magnesium, titanium, aluminum, lanthanum and sulfur and wherein said pellet has an inoculant dissolution rate of at least about 1 mg/sec. to no more than about 320 mg/sec. measured at 30.25 $cm^2$ cross sectional flow area;

passing said molten iron through said filter assembly at a rate of about 1 to about 60 cm/sec. to form inoculated filtered iron;

transporting said inoculated filtered iron to a mold forming a molten shape; and cooling said molten shape to form said molded iron.

55. The process for molding iron of claim 54 wherein said pellet has an inoculant dissolution rate of at least about 2 to about 250 mg/sec.

56. The process for molding iron of claim 54 wherein said filter element comprises a central partial bore and said pellet is received in said central partial bore.

57. The process for molding iron of claim 54 wherein said carrier comprises at least 30%, by weight, ferrosilicon.

58. The process for molding iron of claim 54 wherein said pellet comprises about 0.1–20%, by weight, inoculant.

59. A pellet for inoculating iron in a mold comprising about 40–99.9%, by weight, carrier and about 0.1–60%, by weight, inoculant wherein:

said carrier comprises at least about 30%, by weight, ferrosilicon;

said inoculant comprises at least one inoculating agent selected from a group consisting of cerium, strontium, zirconium, calcium, manganese, barium, bismuth, magnesium, titanium, aluminum, lanthanum and sulfur; and said pellet has an inoculant dissolution rate of at least about 2 to about 250 mg/sec. measured at 15 cm/sec approach velocity with a 30.25 $cm^2$ iron flow.

60. A method for inoculating molten iron comprising passing said molten iron through a filter assembly at an approach velocity of about 1 to about 60 cm/sec. wherein said filter assembly comprises a filter element and an inoculation pellet in contact with said filter element wherein said pellet has an inoculant dissolution rate of at least 1 mg/sec. to no more than 320 mg/sec. and said inoculation pellet comprises an active component comprising about 40–99.9%, by weight, carrier comprising ferrosilicon and about 0.1–60%, by weight, at least one inoculating agent selected from a group consisting of cerium, strontium, zirconium, calcium, manganese, barium, bismuth, magnesium, titanium, aluminum, lanthanum and sulfur.

* * * * *